US006938413B2

(12) United States Patent
Harnischfeger

(10) Patent No.: US 6,938,413 B2
(45) Date of Patent: Sep. 6, 2005

(54) HYDRAULIC CONTROL ARRANGEMENT

(75) Inventor: Edwin Harnischfeger, Jossgrund (DE)

(73) Assignee: Bosch Rexroth AG, Stuttgart (DE)

( * ) Notice: Subject to any disclaimer, the term of this patent is extended or adjusted under 35 U.S.C. 154(b) by 32 days.

(21) Appl. No.: 10/482,067

(22) PCT Filed: May 23, 2002

(86) PCT No.: PCT/DE02/01871

§ 371 (c)(1),
(2), (4) Date: Jan. 20, 2004

(87) PCT Pub. No.: WO03/006753

PCT Pub. Date: Jan. 23, 2003

(65) Prior Publication Data

US 2004/0216455 A1 Nov. 4, 2004

(30) Foreign Application Priority Data

Jul. 13, 2001 (DE) ..... 101 33 616

(51) Int. Cl.[7] ..... F15B 11/02
(52) U.S. Cl. ..... 60/413; 60/469
(58) Field of Search ..... 60/413, 416, 469

(56) References Cited

U.S. PATENT DOCUMENTS 4,502,708 A 3/1985 Taplin
5,520,499 A * 5/1996 Ufheil et al. ..... 60/413
5,802,847 A * 9/1998 Harnischfeger ..... 60/413
5,992,146 A * 11/1999 Hausman ..... 60/413
6,167,701 B1 * 1/2001 Hatcher et al. ..... 60/416
6,321,534 B1 11/2001 A'Hearn et al.
6,357,230 B1 * 3/2002 A'Hearn et al. ..... 60/413

FOREIGN PATENT DOCUMENTS

JP A 08-277548 10/1996
SU 1270241 A1 11/1986

* cited by examiner

*Primary Examiner*—Thomas E. Lazo
(74) *Attorney, Agent, or Firm*—Oliff & Berridge, PLC

(57) ABSTRACT

There is disclosed a hydraulic control arrangement for damping driving vibrations of a mobile machine, comprising a lifting cylinder supporting a working tool whose cylinder chambers can be connected to a fluid source or a tank via a control valve arrangement. The hydraulic control arrangement has a damping valve arrangement including a control valve in which a check valve is integrated through which a bottom-side chamber of the lifting cylinder is connectable to a hydraulic accumulator. In the pressure control function the accumulator can be connected to a tank so that the accumulator pressure is restricted to a maximum value.

10 Claims, 4 Drawing Sheets

HYDRAULIC CONTROL ARRANGEMENT

The invention relates to a hydraulic control arrangement in accordance with the preamble of claim 1.

Such control arrangements are used, for instance, as stabilizing module in wheel loaders so as to dampen the pitch vibrations occurring during driving. From the applicant's DE 197 54 828 C2 a stabilizing module for wheel loaders is known in which an extension arm is supported by hydraulic cylinders. During driving the cylinder chambers of the hydraulic cylinders active in the supporting direction are connected to a hydraulic accumulator. Between the cylinder chambers and the hydraulic accumulator a valve arrangement is disposed including a logic valve which in its blocking position blocks the connection between the hydraulic accumulator and the hydraulic cylinders. A front face of a valve body of the logic valve active in the closing direction can be relieved via an electrically operated directional control valve so that the logic valve can be brought into its opening position by the pressure in the hydraulic accumulator and in the cylinder chambers of the hydraulic cylinders which is active in the opening direction. The rod-side annular chambers of the hydraulic cylinders are connected to the tank via a further logic valve.

The protection of the hydraulic accumulator against excessive pressure in the hydraulic cylinders is effected by a further directional control valve which is adjustable by the pressure in the hydraulic accumulator to a switching position in which the pressure prevailing in the hydraulic accumulator is applied to the front face of the valve body active in the closing direction so that the logic valve is returned into its blocking position and the hydraulic accumulator is protected against overload. In this mode the electrically operated directional control valve is returned to its home position via a pilot valve against the force of the solenoid.

It is a drawback in this solution that for protecting the hydraulic accumulator a considerable effort in terms of devices is necessary with an electrically operated directional control valve controlled via a pilot valve, a further directional control valve for protection and two logic valves allocated to the cylinder chambers and the annular chambers of the hydraulic cylinders, respectively. It is moreover a problem that the reaction behavior of this known stabilizing mode, especially the reaction behavior of the pilot valve preceding the electrically operable directional control valve is too slow to prevent an overload of the hydraulic accumulator. It is a further drawback of this known solution that the logic valve allocated to the annular chambers of the hydraulic cylinder is closed when the hydraulic cylinder is retracted so that cavitations may occur by virtue of the negative pressure in the annular chamber.

In DE 39 09 205 C1 a hydraulic control arrangement is illustrated in which in the driving condition of a machine the cylinder chambers of the hydraulic cylinders are connected to a hydraulic accumulator via an electrically operable directional control valve and the rod-side annular chambers of the hydraulic cylinders are connected to the tank. For controlling the pressure in the hydraulic accumulator a pressure reducing valve for restricting the pressure in the hydraulic accumulator to a maximum value is arranged between the hydraulic accumulator and the hydraulic cylinders. A check valve for preventing a discharge of the hydraulic accumulator via the pressure reducing valve is provided between the pressure reducing valve and the hydraulic accumulator. This pressure reducing valve is disposed in a filling line leading to the hydraulic accumulator to which other consumers are connected as well. Under unfavorable operating conditions it may happen that these other consumers produce pressure peaks which are transmitted to the hydraulic accumulator due to a too slow reaction of the pressure reducing valve. It is not possible to reduce these pressure peaks so that also with this design a damage of the hydraulic accumulators is not excluded.

In the post-published patent application DE 101 04 298.1 an improved control arrangement is shown in which a pilot-controlled check valve is provided in the fluid flow path between the hydraulic cylinder and a valve designed to have a pressure control function so that the hydraulic accumulator is connected, for instance in the case of a too low reaction of the valve provided with a pressure control function, to the allocated cylinder chamber of the hydraulic cylinder via the pilot-controlled check valve so that a damage of the hydraulic cylinder is practically excluded. What is a drawback with this solution, however, is that a considerable effort is required to switch the check valve with the control passages required for unblocking.

In contrast to that, the object underlying the invention is to provide a hydraulic control arrangement for damping driving vibrations of mobile machines by which a damage of a hydraulic accumulator can be prevented with a minimum effort in terms of devices.

This object is achieved by a hydraulic control arrangement.

In accordance with the invention, in a line section between the hydraulic cylinder and the hydraulic accumulator a valve including a pressure control function is arranged in which a check valve is integrated. When a limit pressure is exceeded, the valve is brought into its pressure control position so that the pressure in the hydraulic accumulator is restricted to a maximum pressure. The connection from one of the cylinder chambers to the hydraulic accumulator is effected via the check valve integrated in the valve, this connection being controlled to be closed in the pressure control function. It is possible by the integrated check valve to relieve the hydraulic accumulator toward the tank via the valve in its pressure control function so that pressure peaks caused by other consumers, for instance, which are prevailing in the hydraulic accumulator are reduced as quickly as possible. The operating safety of the control arrangement according to the invention is thus substantially improved vis-à-vis the conventional solutions. Another essential advantage of the solution according to the invention lies in the fact that the effort in terms of devices is lower than in prior art while the functioning is more sophisticated due to the integration of the check valve into the valve.

The valve permitting the pressure control function is designed to have one or two working terminals connected to the bottom of the hydraulic cylinder and/or to the chamber of the hydraulic cylinder accommodating the piston rod, wherein the check valve is accommodated in a valve body, preferably a valve slide of the valve.

In a preferred embodiment a spring and the pressure in the accumulator and, in the opposite direction, a further spring and—depending on the position of the valve body—the tank pressure or the accumulator pressure are applied to the valve body in the pressure control direction.

According to a preferred embodiment, the front faces of the valve body to which pressure has been applied are formed to have different active surfaces. To this end, a measuring piston which is supported with an end portion protruding from the valve body at a housing of the valve is guided in an end portion of the valve body. By the relative displacement of the valve body with respect to the measuring piston a connection between the accumulator terminal and a pressure chamber can be controlled to be opened, the pressure chamber being limited by the front face of the valve body through which the measuring piston is passed so that the accumulator pressure is applied to this front face.

In a variant which is especially easy to manufacture the measuring piston is guided in an axial blind hole bore of the valve body which is connected to the accumulator terminal via bores extending in radial direction.

The effort in terms of manufacture can be further reduced if the axial blind hole bore is formed in a one-piece or multi-piece insert which is inserted into the end portion of the valve body.

A preferably electromagnetically operable directional control valve by which the accumulator pressure and/or the tank pressure can be applied to the front faces of the valve body active as control surfaces is allocated to the valve having the pressure control/pressure reducing function.

In order to increase the operating safety a further pressure control valve by which the pressure in the hydraulic accumulator is limited is provided in the fluid path between the hydraulic accumulator and the valve.

Especially in an embodiment in which the valve having the pressure control function is provided with only one working terminal through which the bottom side of the hydraulic cylinder is connected to the accumulator terminal, the control arrangement according to the invention can be designed to have a control valve by which the rod-side chamber of the hydraulic cylinder can be connected to the tank.

Other advantageous further developments of the invention are the subject matter of the further subclaims.

Hereinafter preferred embodiments of the invention are described in detail by way of schematic drawings in which.

Figure 1:
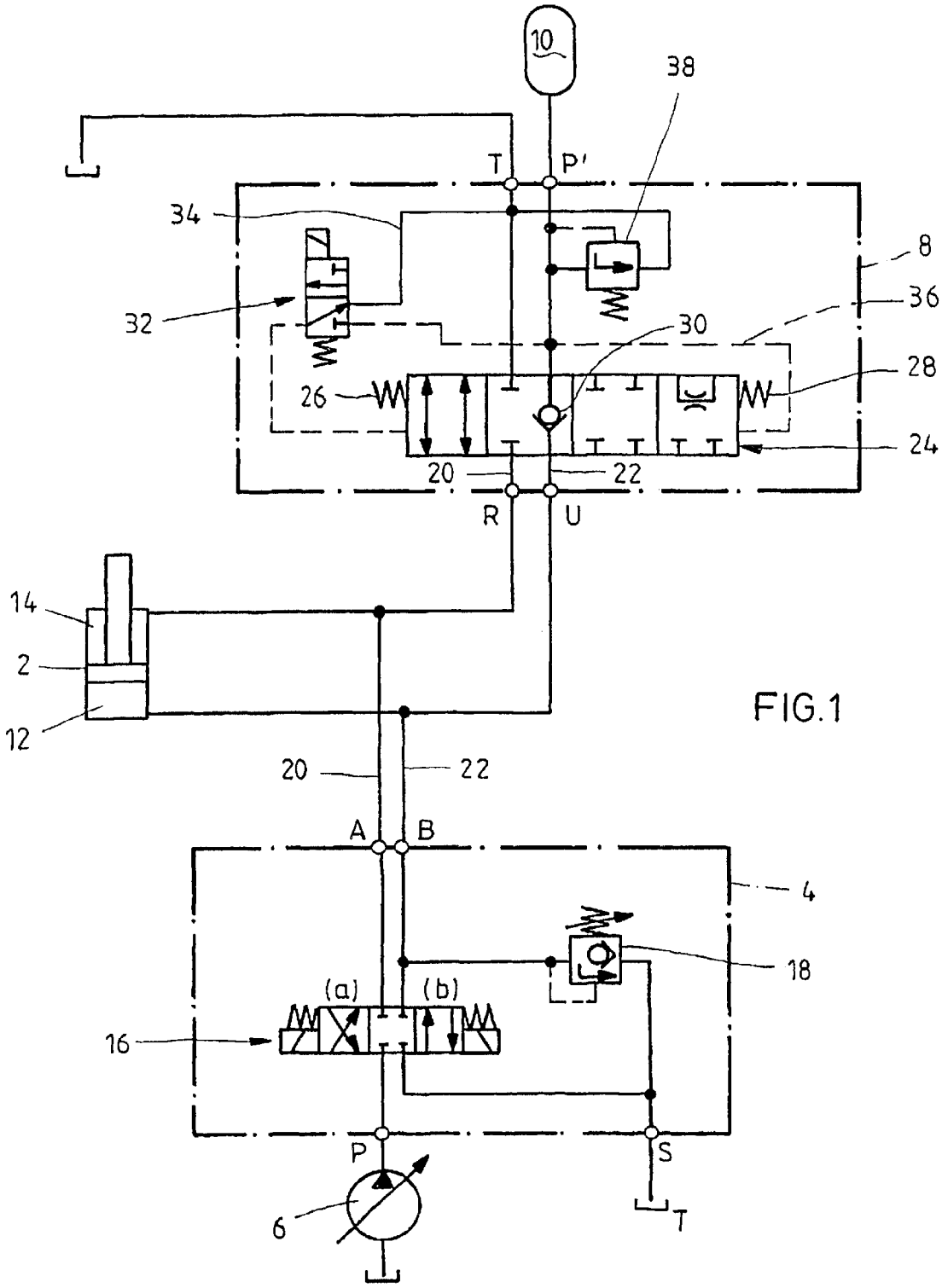
FIG. 1 shows a block diagram of a first embodiment of a control arrangement according to the invention.

In FIG. 1 a simplified block diagram of a control arrangement for controlling a hydraulic cylinder, herein-after referred to as lifting cylinder 2, supporting an extension arm of a mobile machine, for instance a wheel loader, is illustrated. This lifting cylinder can be connected to a hydraulic pump 6 or a tank T via a dash-dot indicated loader control block 4.

The control arrangement shown comprises a likewise dash-dot indicated damping valve arrangement 8 by which vibrations occurring when the wheel loader is driving, for instance pitch vibrations, are damped. This damping valve arrangement 8 is designed so that during the driving condition the lifting cylinder 2 is connected to a hydraulic accumulator 10 so that the pressure prevailing in the hydraulic accumulator 10 is applied to the lifting cylinder 2 in the supporting direction.

In the embodiment shown in FIG. 1 the loader control block 4 includes a pressure terminal P to which the hydraulic pump 6 is connected. Two working terminals A, B of the loader control block 4 can be connected to a cylinder chamber 12 and a rod-side annular chamber 14 of the hydraulic cylinder 2, respectively, via the damping valve arrangement 8. The tank T is connected to a tank terminal S.

The loader control block 4 includes an electrically operable control valve 16 in the form of a 4/3 directional valve which blocks the working terminals A, B against the pressure terminal P and the tank terminal S in its spring-biased home position.

In a first switching position a the pressure terminal P is connected to the working terminal B and the working terminal A is connected to the tank terminal S for extending the hydraulic cylinder 2 so that fluid is supplied into the cylinder chamber 12 and from the annular chamber 14 to the tank T. In the further switching position b the working terminal A is connected to the pressure terminal P and the tank terminal S is connected to the working terminal B for retracting the hydraulic cylinder 2.

For controlling the pressure active at the working terminal B the loader control block 4 has a pressure control valve 18 through which the working terminal B can be connected to the tank terminal S when a maximum pressure, for instance 330 bar, is exceeded.

The damping valve arrangement 8 includes two input terminals R, U connected to the working terminals A, B, a tank terminal T and an accumulator terminal P'. The two input terminals R, U are connected to the input terminals of a control valve 24 through passages 20, 22. The output terminals of the control valve 24 are connected to the tank terminal T and an accumulator terminal P', respectively. The valve slide of the control valve 24 is biased by two springs 26, 28 into its shown home position in which the connection between the working terminal R and the tank terminal T is blocked and the connection from the working terminal U to the accumulator terminal P' is opened in the direction of the hydraulic accumulator 10. The fluid flow in the opposite direction, i.e. from the hydraulic accumulator 10 in the direction of the consumer terminal U and thus toward the bottom of the cylinder is blocked by a check valve 30. This check valve is integrated in the control valve 24.

The damping valve arrangement 8 moreover has a directional control valve 32 which can be electromagnetically operated in the shown embodiment. In a spring-biased home position the directional control valve 32 connects a control passage 34 connected to the tank terminal T to a control chamber of the control valve 24 which is restricted by the front face on the left in FIG. 1 of the valve slide of the control valve 24 so that in the shown switching position of the directional control valve 32 the tank pressure acts on the valve slide in the direction of the spring 26. Via a further control passage 36 the pressure is tapped off at the accumulator terminal P' and is guided into a control chamber of the control valve 24 active in the opposite direction so that the resulting pressure acts in the direction of the further spring 28 (on the right in FIG. 1). When reversing the directional control valve 32 the part of the control passage 34 connected to the tank terminal T is blocked and the part of the control passage 34 extending between the directional control valve 32 and the control valve 24 is connected to the further control passage 36 so that the accumulator pressure is applied to both front faces of the valve slide of the control valve 24. As will be explained in more detail hereinafter, the front face on the right in FIG. 1 of the valve slide of the control valve 24 has a smaller active surface than the left front face so that in the above-mentioned switching position of the directional control valve 32 the valve slide of the control valve 24 is moved to the right so that the connection between the terminal R and the tank terminal T as well as the connection between the working terminal U and the accumulator terminal P' are controlled to be opened—the lifting cylinder 2 is supported by the pressure acting in the hydraulic accumulator 10.

The damping valve arrangement 8 moreover includes a pressure reducing valve 38 by which the pressure in the hydraulic accumulator 10 is restricted to a maximum value even when the directional control valve 32 is reversed.

It is assumed that when taking the wheel loader into operation the shovel hinged to the extended arm is lying on the ground. After starting the engine the control valve 16 is brought into its switching position denoted with a so that the bottom-side cylinder chamber 12 of the lifting cylinder 2 is supplied with fluid via the pump 6, while the rod-side annular chamber 14 is connected to the tank T—the lifting cylinder 2 is extended and the shovel is lifted from the ground. The cylinder chamber 12 is connected to the hydraulic accumulator 10 via the passage 22, the control valve 24 provided in its shown home position and the check valve 30. The bearing pressure of the lifting cylinder 2 is about 30 to 50 bar in the unloaded condition—depending on the weight of the shovel.

If this pressure is increased due to the loading of the shovel during work, the valve slide of the control valve 24 is shifted by the control pressure prevailing in the control passage 36 corresponding to the pressure in the hydraulic accumulator from its spring-biased home position to a control position having a pressure reducing function in which the pressure guided to the hydraulic accumulator 10 is reduced to a limit value, for instance 120 bar. In this pressure reducing function the connection from the input terminal U to the accumulator terminal P' is controlled to be closed. The control pressure in the passage active in the direction of the spring 26 is equal to the tank pressure, because the directional control valve 32 is still in its shown home position.

It is not possible to fill the hydraulic accumulator 10 beyond the pressure adjusted in the pressure reducing function, because the control valve 24 then is provided in the shown blocking function.

In case that the pressure in the hydraulic accumulator 10 is further increased above the aforementioned limit of 120 bar, for instance, due to interactions with other consumers, vibrations, temperature changes etc., the control valve 24 can be brought into a pressure controlling position (on the right in FIG. 1) in which the hydraulic accumulator 10 is connected to the tank by the corresponding pressure in the passage 36 so that a maximum pressure control to 150 bar, for instance, is realized.

In this way a relieving blow by an excessive maximum pressure in the hydraulic accumulator 10 in the case of a lower pressure in the the hydraulic cylinder 2 and when controlling the solenoid valve 32 is prevented with a minimum effort.

In case that the pressure in the cylinder chamber 12 decreases below 120 bar, the check valve 30 prevents the pressure in the hydraulic accumulator 10 from relieving.

If the wheel loader is now driven to the working spot, at first the control valve 16 is brought into its central neutral position in which the terminals A, B and P, S are blocked against each other. Moreover the directional control valve 32 is reversed so that the accumulator pressure is applied to both control surfaces of the control valve 24.

Due to the difference of the front faces the valve slide is then shifted to the right in the representation according to FIG. 1 so that the terminals U and P' as well as R and T' are controlled to be opened, i.e. the annular chamber 14 is then connected to the tank while the bottom-side cylinder chamber 12 is connected to the hydraulic accumulator 10.

The lifting cylinder 2 is maintained in its supporting position by the pressure in the accumulator 10. As pressure is constantly applied to the hydraulic accumulator 10 when the system is turned on, the extension arm is reliably prevented from being lowered. The pressure control function of the control valve 24 is taken over by the pressure control valve 38 in the driving condition.

Figure 2:
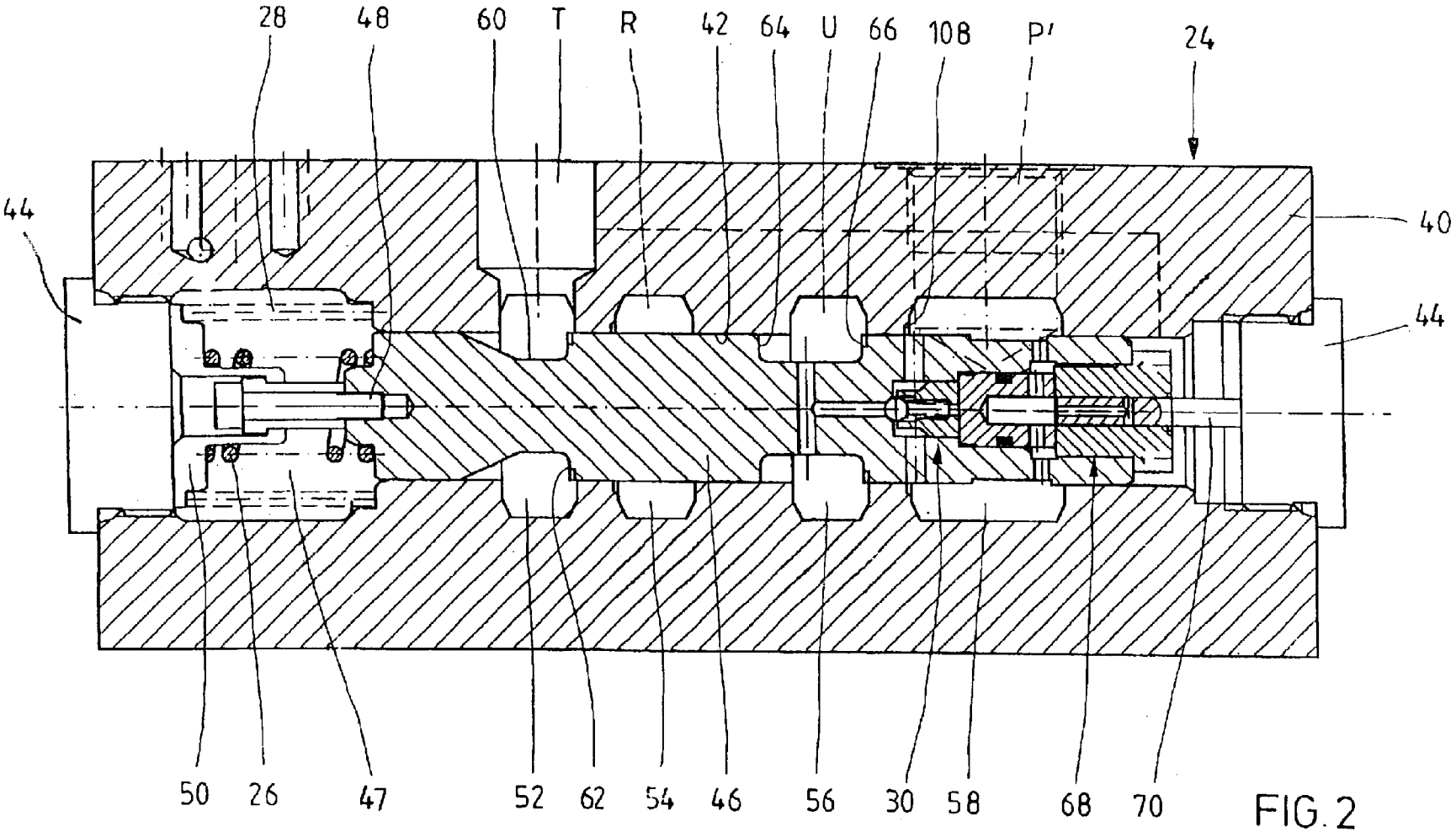
FIG. 2 shows a section across a valve of the control arrangement of FIG. 1.

In the solution according to the invention the pressure reducing and pressure control functions of the control valve 24 are combined in one single valve the structure of which is described by way of FIG. 2.

FIG. 2 shows a longitudinal section across an embodiment of a control valve 24 of the damping valve arrangement 8. The control valve 24 comprises a housing 40 through which a valve bore 42 is passed. The front-side end portions of the valve bore 42 are closed by sealing caps 44. In the valve bore 42 the already afore-mentioned valve slide 46 is guided which is biased in its home position by the springs 26, 28. In the shown embodiment the two springs 26, 28 are accommodated in a joint spring chamber 47. The spring 26 acts as a pressure spring which moves the valve slide 46 to the right (FIG. 2), whereas the spring 28 moves the valve slide 46 into the opposite direction. To this end, a stop screw 48 whose head is guided to be axially movable in a cup-shaped spring plate 50 is screwed into the front face on the left in FIG. 2 of the valve slide 46. This spring plate is biased by the spring 28 supported at a shoulder of the housing 40 against the sealing cap 44. In the home position shown in FIG. 2 the head of the stop screw 48 is adjacent to the spring plate 50 so that an axial displacement of the valve slide 46 to the right (FIG. 2) is possible only against the force of the spring 28. With such an axial displacement of the valve slide 46 the spring plate 50 is lifted off the sealing cap 44. The spring 26 is likewise supported at the spring plate 50.

In the housing 40 four annular chambers 52, 54, 56 and 58 are formed, wherein the annular chamber 52 is connected to the tank terminal T, the annular chamber 54 is connected to the rod-side terminal R, the annular chamber 56 is connected to the bottom-side terminal U and the annular chamber 58 is connected to the accumulator terminal P'.

In the area of the annular chamber 52 the valve slide 46 has an annular groove 60 by which a control edge 62 is formed. A further annular groove 64 by which a control edge 66 is formed is provided in the area of the annular chamber 56.

An insert 68 including a measuring piston 70 and the check valve 30 is inserted in the end portion of the valve slide 46 on the right in FIG. 2. An end portion of the measuring piston 70 axially projecting from the valve slide 46 is adjacent to the right sealing cap 44.

Figure 3:
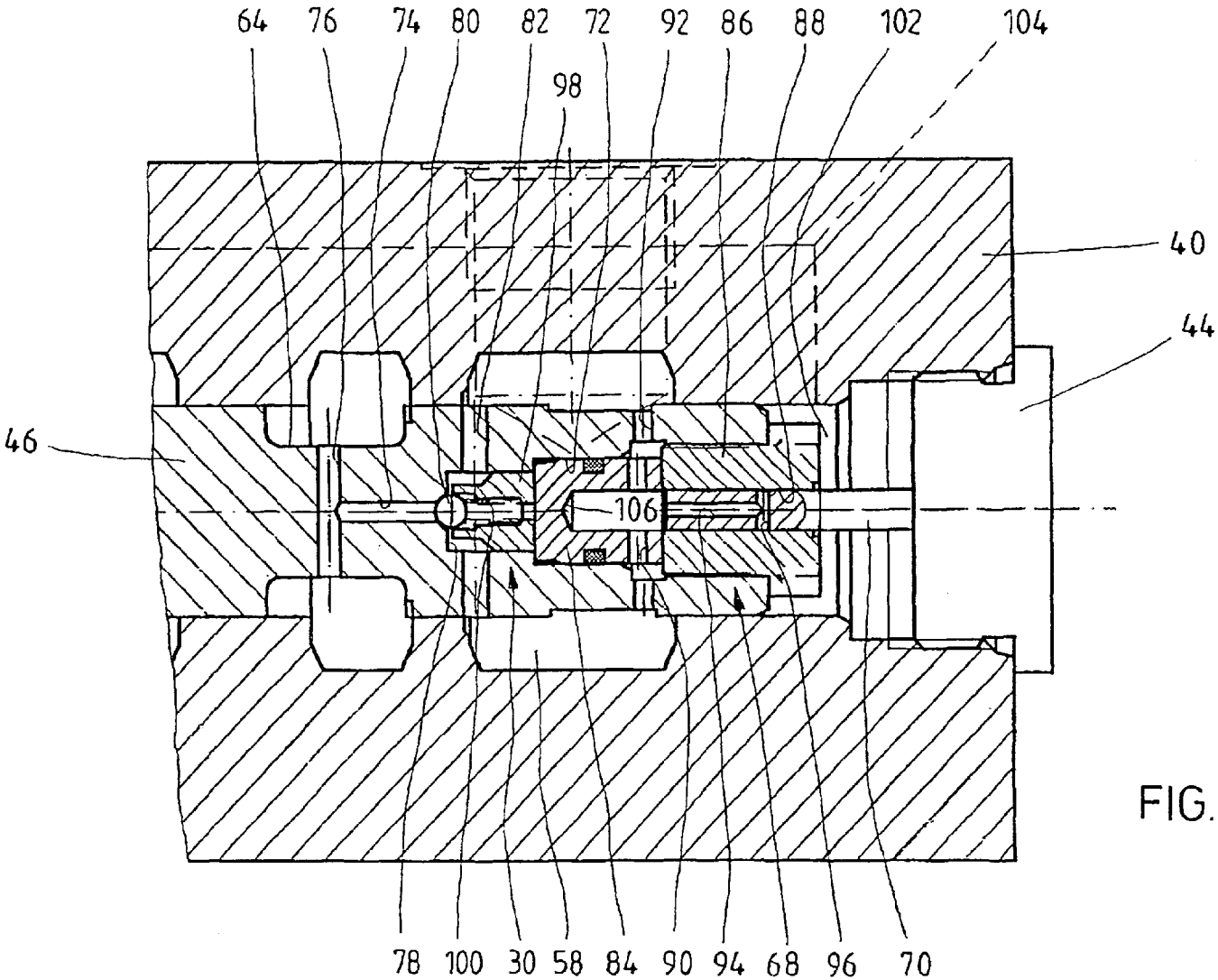
FIG. 3 shows an enlarged detail representation of the valve of FIG. 2

The part of the valve slide 46 on the right in FIG. 2 including the multi-piece insert 68 in the measuring piston 70 is illustrated in FIG. 3 by way of an enlarged representation. The valve slide 46 has a bore 72 opening in the front face on the right in FIG. 3 which then forms a passage 74. This passage ends in a transverse bore which opens into the bottom of the annular groove 64.

The bore 72 is radially stepped back toward the passage 74, wherein the front face adjacent to the passage 74 is formed as a valve seat 78 for a closing member 80 of the check valve 30. The chamber adjacent to the valve seat 78 is connectable to the annular chamber 58 via sheath bores 82 of the valve slide 46 so that, when the closing member 80 is lifted off the valve seat 78, fluid can flow via the transverse bores 76, the passage 74 and the sheath bores 82 to the accumulator terminal P'.

The insert 68 has a multi-piece design in the shown embodiment and is screwed into the bore 72. In the variant as represented, the insert 68 includes a center piece 84 and an end piece 86, one shoulder of the latter being supported on the front face of the valve slide 46 on the right in FIG. 3. An axial blind hole bore 88 in which the measuring piston 70 is guided passes through the center piece 84 and the end piece 86.

Moreover a connecting bore 90, which opens in the axial blind hole bore 88 on the one hand and in openings 92 on the other hand, passes through the center piece 84. The axial blind hole bore 88 is connected to the annular chamber 58 via openings 92 in the valve slide 46 and the connecting bore 90.

An internal bore 94 which ends at the outer periphery of the measuring piston 70 with a radial leg 96 passing through the measuring piston 70 in the radial direction opens into the front face of the measuring piston 70 facing the connecting bores 90. These radial legs are closed by the circumferential wall of the axial blind hole bore 88 in the shown home position.

A housing body 98 of the check valve 30 in which the closing member 80 is guided during lifting and in which the closing spring 100 biasing the closing member 80 against the valve seat 78 is bedded is supported at the center piece 84.

A sealing is provided at the outer periphery of the center piece 84 so that no leakage can occur along the outer periphery of the center piece.

The control chamber 102 adjacent to the end piece 86 is connected to the tank terminal by a tank passage 104 indicated in broken lines so that tank pressure is applied to the control chamber 102 in the shown position.

The directional control valve 32 illustrated in FIG. 1 as well as the pressure control valve 38 can likewise be accommodated in the housing 40 of the control valve 24.

Either the tank pressure or the accumulator pressure can be applied to the spring chamber 47 through the directional control valve 32 integrated in the housing 40.

The bottom 106 (see FIG. 3) of the axial blind hole bore 88 disposed in the center piece 84 is connected to the accumulator terminal P' through the connecting bores 90, the opening 92 and the annular chamber 58 so that a corresponding resultant pressure force in the representation according to FIG. 3 acts on the valve slide to the left. I.e. in the home position of the directional control valve the tank pressure is applied in the spring chamber 47 and in the control chamber 102, whereas the accumulator pressure is applied to the bottom 106. At a predetermined pressure prevailing in the hydraulic accumulator 10 the valve slide 46 is in its home position shown in FIG. 2 in which the connection between the rod-side terminal R and the tank terminal T is blocked, while the connection from the bottom-side terminal U to the accumulator terminal P' is opened through the check valve 30. In the opposite direction the check valve 30 blocks the connection between the accumulator terminal P' and the terminal U.

When the pressure is increased at the accumulator terminal P', the valve slide 46 is moved to the left from the home position according to FIG. 2 by the resultant pressure force acting on the bottom 106, the measuring piston 70 being further biased against the sealing cap 44 by the pressure in the axial blind hole bore. During this axial displacement the sheath bore 82 is controlled to be closed by a control edge 108 (FIG. 2) of the annular chamber 58 so that the connection between the terminals U and P' is controlled to be closed—the control valve 24 is provided in its pressure reducing function. In the case of a further axial displacement of the valve slide 46 the latter connection is completely blocked and the radial legs 96 of the measuring piston 70 are controlled to be opened by the front-side circumferential edge of the axial blind hole bore 88 so that the control chamber 102 is connected to the accumulator terminal P' through the radial legs 96, the internal bore 94, the part of the axial blind hole bore 88 connected thereto, the connecting bores 90 and the openings 92—the pressure in the hydraulic accumulator 10 can then be decreased via this fluid path toward the tank—the control valve is provided in its pressure control function.

As mentioned in the beginning—in the driving operation the directional control valve 32 is reversed so that the accumulator pressure acts both in the spring chamber 47 and on the bottom 106. The control chamber 102 is connected to the tank. Due to the difference of the front faces the valve slide 46 is displaced to the right from its home position shown in FIG. 2 so that the connection between the terminals R and T as well as U and P' is controlled to be opened by the control edges 62 and/or 66—the lifting cylinder 2 is supported by the pressure in the hydraulic accumulator 10. Possibly occurring pressure peaks can be decreased via the pressure control valves 38 or 18 toward the tank. The check valve 30 has no effect in this operating position.

Of course, the passage can also be guided in a way different from the representation in the FIGS. 2 and 3 in the area of the check valve 30 and of the measuring piston 70. For instance, instead of the radial openings also oblique bores can be used. The springs 28, 26 can be accommodated in separate spring chambers (spring 26 in the spring chamber 47, spring 28 in the control chamber 102).

In the embodiment as shown in FIG. 1 the rod-side annular chamber 14 of the lifting cylinder 2 is connected to the tank through the control valve 24.

Figure 4:
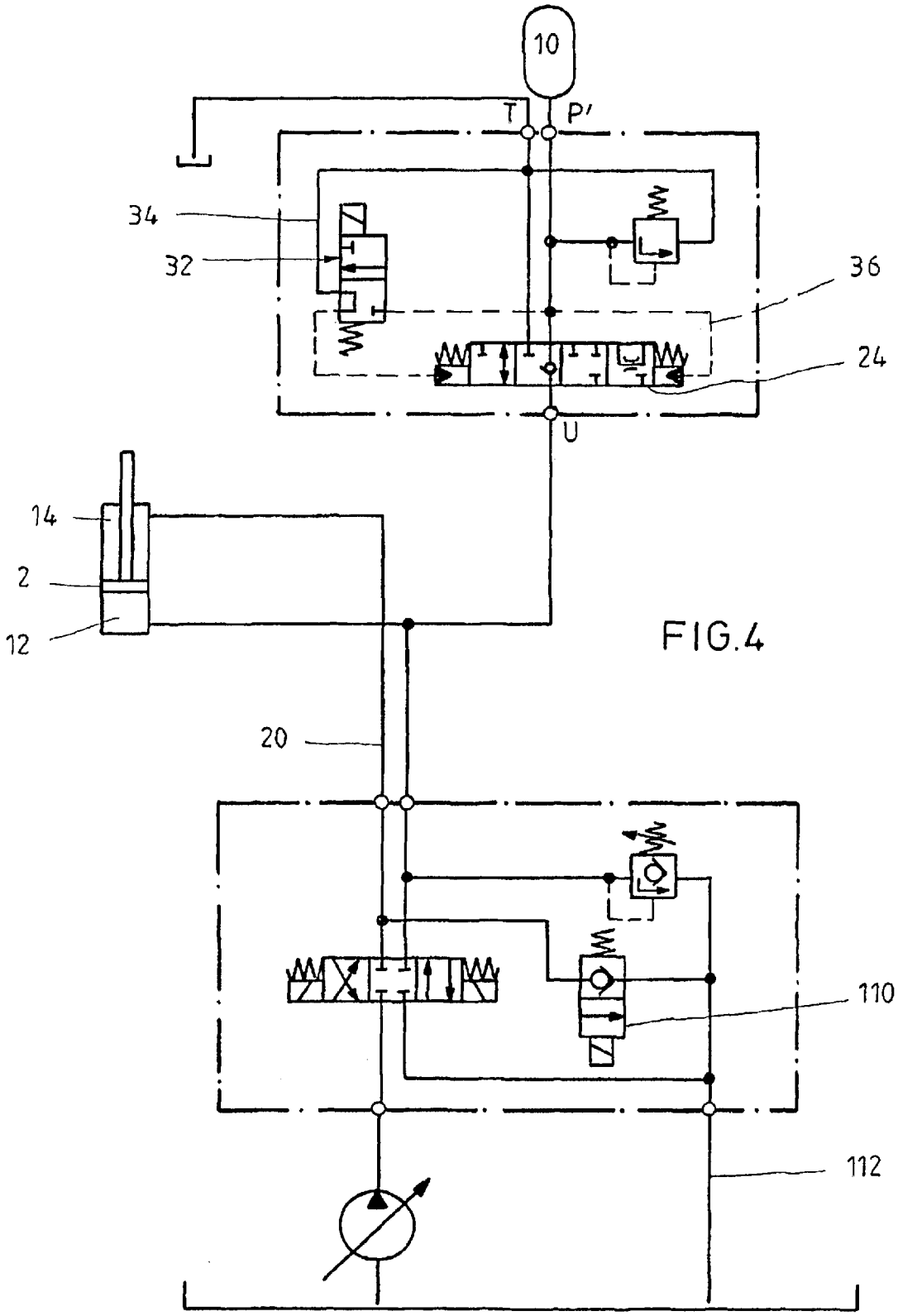
FIG. 4 shows a further embodiment of a control arrangement according to the invention comprising a valve having a pressure control function and showing a simpler structure compared to the afore-described solutions.

In FIG. 3 a variant is illustrated in which the control valve 24 is provided to have merely three terminals, wherein, in response to the position of the control valve 24, the bottom-side cylinder chamber 12 of the lifting cylinder 2 can be connected to or blocked against—as in the above-described embodiment—either the hydraulic accumulator 10 or the tank. The connection of the rod-side annular chamber 14 to the tank T is effected by a control valve 110 designed to have a feeding function in the embodiment shown in FIG. 4. In its spring-biased home position the connection from the passage 20 to a tank passage 112 is blocked by the control valve 110, while in the case of an insufficient supply a fluid flow is ensured from the tank to the passage 20 and thus to the annular chamber 14 via the integrated check valve of the control valve 110. When driving the control valve 110 the passage 20 is directly connected to the tank passage 112 so that the fluid can flow off from the annular chamber 14 to the tank.

The directional control valve 32 connects in its home position the control passage 34 connected to the tank terminal T to the control chamber adjacent to the left front face of the valve slide 46, whereas the pressure in the hydraulic accumulator 10 is applied to the control surface of the valve slide active in the opposite direction via the control passage 36. When reversing the directional control valve 32 the pressure in the hydraulic accumulator 10 is applied to both control surfaces so that the valve slide is turned to the right into its opening position in which the terminals U and P' are directly connected to each other. For the rest, the embodiment illustrated in FIG. 4 corresponds to the above-described embodiment so that further explanations can be dispensed with.

There is disclosed a hydraulic control arrangement for damping driving vibrations of a mobile machine, comprising a lifting cylinder supporting a working tool whose cylinder chambers can be connected to a fluid source or a tank via a control valve arrangement. The hydraulic control arrangement comprises a damping valve arrangement including a control valve in which a check valve is integrated through which a bottom-side chamber of the lifting cylinder is connectable to a hydraulic accumulator. In the pressure control function the accumulator can be connected to a tank so that the accumulator pressure is restricted to a maximum value.

List of Reference Numerals

2 lifting cylinder
4 loader control block
6 pump
8 damping valve arrangement
10 hydraulic accumulator
12 cylinder chamber
14 annular chamber
16 control valve
18 pressure control valve
20 passage
22 passage
24 control valve
26 spring
28 spring
30 check valve
32 directional control valve
34 control passage
36 further control passages
38 pressure control valve
40 housing
42 valve bore
44 sealing caps
46 valve slide
47 spring chamber
48 stop screw
50 spring plate
52 annular chamber
54 annular chamber
56 annular chamber
58 annular chamber
60 annular groove
62 control edge
64 annular groove
66 control edge
68 insert
70 measuring piston
72 bore
74 passage
76 transverse bore
78 valve seat
80 closing member
82 sheath bores
84 center piece
86 end piece
88 axial blind hole bore
90 connecting bore
92 opening
94 internal bore
96 radial leg
98 housing body
100 closing spring
102 control chamber
104 tank passage
106 bottom
108 control edge
110 control valve
112 tank passage

What is claimed is:

1. A hydraulic control arrangement for damping driving vibrations of a mobile machine, comprising a hydraulic cylinder (2) supporting a working tool the cylinder chambers (12, 14) of which are connectable to a fluid source (6, 10) or a tank (T) via a control valve arrangement (4), and comprising a damping valve arrangement (8) for connecting a cylinder chamber (12) to a hydraulic accumulator (10) and another cylinder chamber (14) to the tank (T), wherein the damping valve arrangement includes a valve (24) for influencing the pressure in the hydraulic accumulator (10) and a check valve (30) for preventing a backflow of the fluid from the hydraulic accumulator (10) to the cylinder chamber (12), characterized in that the valve (24) has a pressure control function through which a connection between the hydraulic accumulator (10) and the tank (T) can be controlled to be opened when a limit pressure is exceeded, and in that the check valve (30) is disposed in a passage (74, 82) of the valve (24) through which the terminal (U) connected to a cylinder chamber is connectable to an accumulator terminal (P') connected to the hydraulic accumulator (10), wherein the passage (74, 82) can be controlled to be closed when driving the valve (24) in the direction of the pressure control function.

2. A control arrangement in accordance with claim 1, wherein the valve (24) comprises a tank terminal, a terminal connected to the bottom-side cylinder chamber (12) of the lifting cylinder (2), an accumulator terminal or the aforementioned terminals and a further working terminal connected to the cylinder chamber (14) of the hydraulic cylinder (2) at the piston rod side and the passage (74, 82) is integrated with the check valve (30) into the valve body (46).

3. A control arrangement in accordance with claim 2, wherein a spring (28) and the pressure in the accumulator can be applied to the valve body (46) in the pressure control direction and another spring (26) and the tank pressure or the accumulator pressure can be applied in the opposite direction.

4. A control arrangement in accordance with claim 3, wherein a measuring piston (70) is guided in a front face of the valve body (46) active in the pressure control direction, which measuring piston is supported at a housing (40) of the valve (24) by one end portion and through which a connection between the accumulator terminal and a control chamber (102) adjacent to the front face can be controlled to be opened.

5. A control arrangement in accordance with claim 4, wherein the measuring piston (70) is guided in an axial blind hole bore (88) of the valve body (46) which is connected to an annular chamber (58) allocated to the accumulator terminal through bores (90, 92).

6. A control arrangement in accordance with claim 5, wherein the passage (74, 82) opens into the annular chamber (58) at an axial distance from the bores (90, 92), wherein the opening area can be controlled to be closed when displacing the valve body (46) in the pressure control direction.

7. A control arrangement in accordance with claim 5, wherein the valve body (46) has a one-piece or multi-piece insert (68) in which the axial blind hole bore (88) and at least a portion of the bores (90, 92) are formed.

8. A control arrangement in accordance with claim 3, wherein a preferably electromagnetically operable directional control valve (32) is allocated to the valve (24) through which directional control valve in a switching position the accumulator pressure is applicable to control surfaces of the valve body, while in a spring-biased home position of the directional control valve (32) the tank pressure is applied to a control surface of the valve (24) active in the open position.

9. A control arrangement in accordance with claim 1, wherein a pressure control valve (38) by which the pressure in the hydraulic accumulator (10) can be controlled is provided between the hydraulic accumulator (10) and the valve (24).

10. A control arrangement in accordance with claim 1, comprising a control valve (110) through which the other cylinder chamber (14) is connectable to the tank.

* * * * *